US007614966B2

(12) United States Patent
Hirau et al.

(10) Patent No.: US 7,614,966 B2
(45) Date of Patent: Nov. 10, 2009

(54) GOLF BALL

(75) Inventors: Tsutomu Hirau, Kobe (JP); Seiichiro Endo, Kobe (JP); Kazuya Kamino, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 11/783,847

(22) Filed: Apr. 12, 2007

(65) Prior Publication Data

US 2007/0265113 A1 Nov. 15, 2007

(30) Foreign Application Priority Data

May 10, 2006 (JP) ..... 2006-131091
May 17, 2006 (JP) ..... 2006-137154

(51) Int. Cl.
*A63B 37/06* (2006.01)

(52) U.S. Cl. ..... 473/376

(58) Field of Classification Search ..... 473/376, 473/373, 374, 368
See application file for complete search history.

(56) References Cited

U.S. PATENT DOCUMENTS 5,976,035 A * 11/1999 Umezawa et al. ..... 473/364
6,123,630 A * 9/2000 Hayashi et al. ..... 473/376
6,248,027 B1 6/2001 Hayashi et al.
6,569,036 B1 * 5/2003 Takemura et al. ..... 473/376

FOREIGN PATENT DOCUMENTS

| | | | |
|---|---|---|---|
| JP | 10-328325 | A | 12/1998 |
| JP | 10-328328 | A | 12/1998 |
| JP | 11-4916 | A | 1/1999 |
| JP | 2003-52856 | A | 2/2003 |
| JP | 2003-111870 | A | 4/2003 |
| JP | 2005-224515 | A | 8/2005 |
| JP | 2006-34740 | A | 2/2006 |

* cited by examiner

*Primary Examiner*—Raeann Trimiew
(74) *Attorney, Agent, or Firm*—Birch, Stewart, Kolasch and Birch LLP

(57) ABSTRACT

A golf ball containing a core, a reinforcing layer and a cover. The core is formed by a center and a mid layer. The center is formed by a center inner sphere and a center outer layer. The center inner sphere and the center outer layer are obtained through crosslinking of a rubber composition. The base polymer of the mid layer is an ionomer resin. The base polymer of the cover is a thermoplastic polyurethane elastomer. The thickness Tc of the cover is equal to or less than 1.0 mm. The hardness Hc of the cover is 20 or greater and 50 or less. The ratio (D2/D3) of the amount of compressive deformation D2 of the core to the amount of compressive deformation D3 of the golf ball is 0.98 or greater and 1.10 or less.

22 Claims, 1 Drawing Sheet

GOLF BALL

This application claims priority on Patent Application No. 2006-131091 filed in JAPAN on May 10, 2006 and Patent Application No. 2006-137154 filed in JAPAN on May 17, 2006. The entire contents of these Japanese Patent Applications are hereby incorporated by reference.

BACKGROUND OF THE INVENTION

1. Field of the Invention

The present invention relates to golf balls. More particularly, the present invention relates to multi-piece golf balls having a center inner sphere, a center outer layer, a mid layer and a cover.

2. Description of the Related Art

Top concern to golf players for golf balls is their flight performances. The golf players particularly place great importance on flight distance attained upon shots with a driver.

The golf players also place great importance on flight distance upon shots with a long iron and a middle iron. The flight performance greatly depends on resilience performances.

The golf players place great importance also on spin performances of the golf balls. Great back spin rate results in small run. For golf players, golf balls which are liable to be spun backwards are apt to be rendered to stop at a targeted position. Great side spin rate results in easily curved trajectory of the golf ball. For golf players, golf balls which are liable to be spun sidewise are apt to allow their trajectory to curve intentionally. The golf balls that are excellent in spin performances are excellent in control performances. High-level golf players particularly place great importance on control performances upon shots with a short iron.

For golf players, stability of spin rate is also important. With a golf ball having variance of the spin rate, it is not easy to obtain the intended trajectory by the golf players.

Upon shots with an iron, the golf ball is rubbed with the face of the club. Due to this rubbing, the surface of the golf ball may be scuffed. Greatly scuffed golf balls can be no longer used. Scuff resistance performances are also important for golf balls.

In light of improvement of performances, a variety of proposals have been made with respect to golf balls. U.S. Pat. No. 6,123,630 (JP-A-10-328325) discloses a four-piece golf ball comprising a core having two-layer structure and a cover having two-layer structure. The core is formed by an inner sphere and an outer layer. The surface hardness of the core is less than that of the inner sphere. U.S. Pat. No. 6,248,027 (JP-A-10-328328) discloses a four-piece golf ball comprising a core having two-layer structure and a cover having two-layer structure. The core is formed by an inner sphere and an outer layer. The surface hardness of the core is less than that of the inner sphere.

Requirements for golf balls by golf players have been increasingly escalated in recent years. Balance of a higher order among the performances has been desired. An object of the present invention is to provide a golf ball that is excellent in the resilience performance, the spin performance, the spin stability and the scuff resistance performance.

SUMMARY OF THE INVENTION

A golf ball according to one aspect of the present invention, has a core and a cover positioned outside of this core. The core has a spherical center and a mid layer positioned outside of this center. The center has a center inner sphere and a center outer layer positioned outside of the center inner sphere. This cover has a thickness Tc of equal to or less than 1.0 mm. This cover has a hardness Hc of 20 or greater and 50 or less. A ratio (D2/D3) of an amount of compressive deformation D2 of the core to an amount of compressive deformation D3 of the golf ball is 0.98 or greater and 1.10 or less.

According to conventional golf balls having a soft cover, this cover is responsible for the spin performance. This soft cover is likely to deteriorate the resilience performance. In conventional golf balls, deterioration of the resilience performance due to the cover is suppressed by employing a thin cover. However, too thin cover cannot be responsible for the spin performance enough. In the golf ball according to the present invention, the ratio (D2/D3) is close to 1.00. In other words, the cover gives a small influence on an amount compressive deformation of the golf ball. The cover has a low hardness and is thin. By employing a cover with a small hardness, the cover is responsible for the spin performance and the spin stability irrespective of being thin. Further, this cover is also responsible for the scuff resistance performance. The golf ball according to the present invention is excellent in all terms of the resilience performance, the spin performance and the spin stability.

A golf ball according to another aspect of the present invention has a spherical core, and a cover positioned outside of this core. The core has a spherical center and a mid layer positioned outside of this center. The center has a center inner sphere and a center outer layer positioned outside of the center inner sphere. A product (Tc·Hc) of the thickness Tc (mm) of the cover and the hardness Hc of the cover is equal to or less than 25. This golf ball has an amount of compressive deformation of 2.20 or greater and 2.90 or less.

In this golf ball, the cover can be responsible for the spin performance and the spin stability irrespective of being thin, by employing the cover having the product (Tc·Hc) of equal to or less than 25. This cover can be further responsible for the scuff resistance performance. The thin cover does not deteriorate the resilience performance. The golf ball is excellent in all terms of the resilience performance, the spin performance, the spin stability and the scuff resistance performance.

DESCRIPTION OF THE PREFERRED EMBODIMENTS

Figure 1:
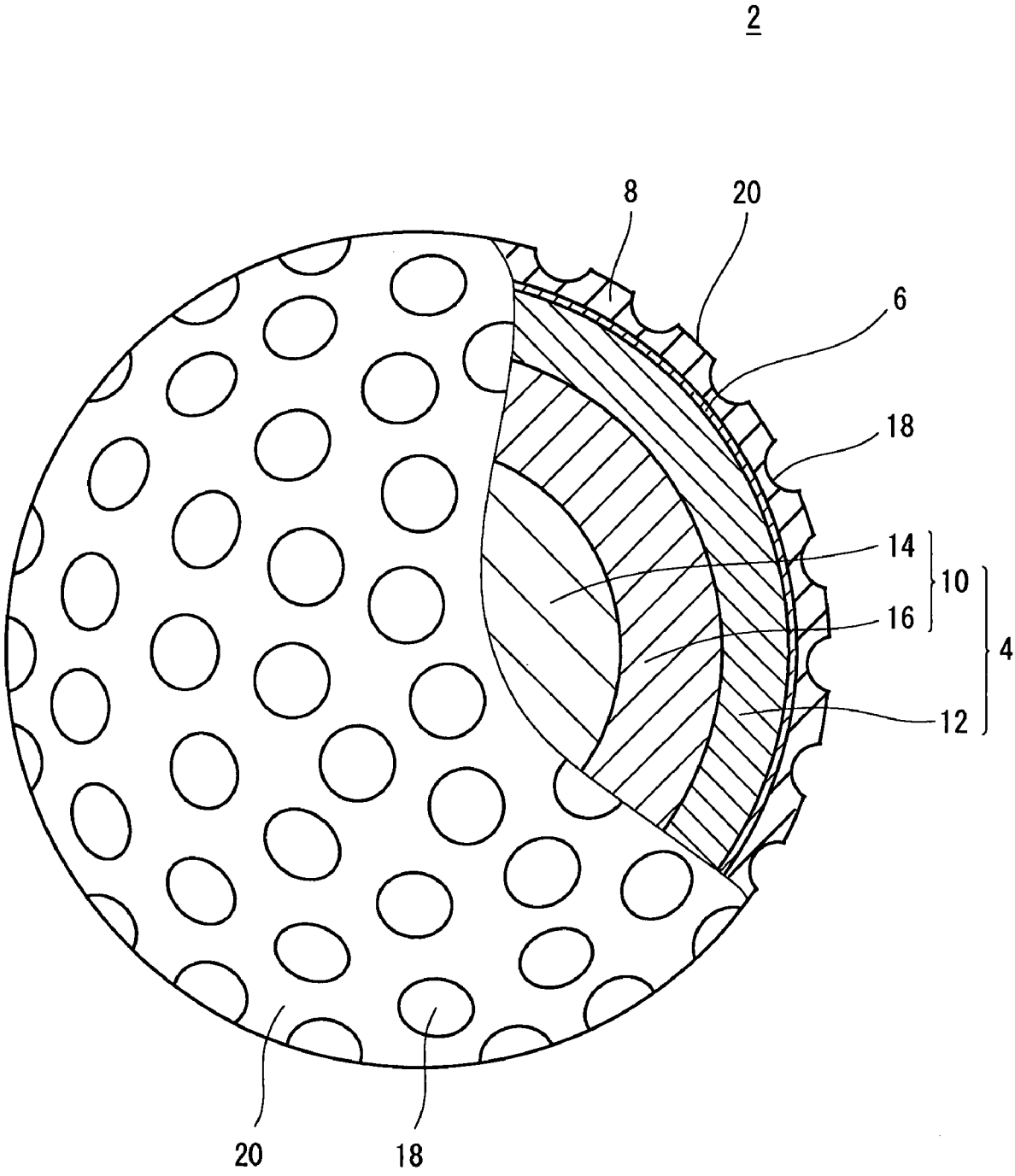
FIG. 1 is a partially cut off cross-sectional view illustrating a golf ball according to one embodiment of the present invention.

The present invention will be hereinafter described in detail with appropriate references to the accompanying drawing according to preferred embodiments.

Golf ball 2 illustrated in FIG. 1 has a spherical core 4, a reinforcing layer 6 positioned outside of this core 4, and a cover 8 positioned outside of this reinforcing layer 6. The core 4 has a spherical center 10, and a mid layer 12 positioned outside of this center 10. The center 10 has a center inner sphere 14 and a center outer layer 16 positioned outside of this inner sphere 14. Numerous dimples 18 are formed on the surface of the cover 8. Of the surface of the cover 8, a part other than the dimples 18 is a land 20. This golf ball 2 has a paint layer and a mark layer to the external side of the cover 8, although these layers are not shown in the FIGURE.

This golf ball 2 has a diameter of from 40 mm to 45 mm. From the standpoint of conformity to a rule defined by United States Golf Association (USGA), the diameter is preferably equal to or greater than 42.67 mm. In light of suppression of the air resistance, the diameter is preferably equal to or less than 44 mm, and more preferably equal to or less than 42.80 mm. Weight of this golf ball 2 is 40 g or greater and 50 g or less. In light of attainment of great inertia, the weight is preferably equal to or greater than 44 g, and more preferably equal to or greater than 45.00 g. From the standpoint of conformity to a rule defined by USGA, the weight is preferably equal to or less than 45.93 g.

The center inner sphere 14 is formed by a composition including a thermosetting polymer as a base. Specifically, the inner sphere 14 is obtained through crosslinking of a rubber composition. Examples of preferable base rubber include polybutadienes, polyisoprenes, styrene-butadiene copolymers, ethylene-propylene-diene copolymers and natural rubbers. In light of the resilience performance, polybutadienes are preferred. When other rubber is used in combination with polybutadiene, it is preferred that the polybutadiene is included as a principal component. Specifically, it is preferred that percentage of polybutadiene to the entire base rubber is equal to or greater than 50% by weight, and particularly equal to or greater than 80% by weight. Polybutadienes having a percentage of cis-1,4 bonds of equal to or greater than 40%, and particularly equal to or greater than 80% are particularly preferred.

For crosslinking of the inner sphere 14, a co-crosslinking agent is used. Preferable examples of the co-crosslinking agent in light of the resilience performance include monovalent or bivalent metal salts of an α,β-unsaturated carboxylic acid having 2 to 8 carbon atoms. Specific examples of preferable co-crosslinking agent include zinc acrylate, magnesium acrylate, zinc methacrylate and magnesium methacrylate. Zinc acrylate and zinc methacrylate are particularly preferred on the grounds that a high resilience performance can be achieved.

As a co-crosslinking agent, an α,β-unsaturated carboxylic acid having 2 to 8 carbon atoms, and a metal oxide may be also blended. Both components react in the rubber composition to give a salt. This salt is responsible for the crosslinking reaction. Examples of preferable α,β-unsaturated carboxylic acid include acrylic acid and methacrylic acid. Examples of preferable metal oxide include zinc oxide and magnesium oxide.

The amount of the co-crosslinking agent to be blended is preferably 10 parts by weight or greater and 40 parts by weight or less per 100 parts by weight of the base rubber. By setting the amount to be equal to or greater than 10 parts by weight, excellent resilience performance can be achieved. In this respect, the amount is more preferably equal to or greater than 15 parts by weight. By setting the amount to be equal to or less than 40 parts by weight, excellent feel at impact can be achieved. In this respect, the amount is more preferably equal to or less than 35 parts by weight.

Preferably, the rubber composition of the inner sphere 14 includes an organic peroxide together with the co-crosslinking agent. The organic peroxide serves as a crosslinking initiator. The organic peroxide is responsible for the resilience performance. Examples of suitable organic peroxide include dicumyl peroxide, 1,1-bis(t-butylperoxy)-3,3,5-trimethylcyclohexane, 2,5-dimethyl-2,5-di(t-butylperoxy)hexane and di-t-butyl peroxide. Particularly versatile organic peroxide is dicumyl peroxide.

The amount of the organic peroxide to be blended is preferably 0.1 part by weight or greater and 3.0 parts by weight or less per 100 parts by weight of the base rubber. By setting the amount to be equal to or greater than 0.1 parts by weight, excellent resilience performance can be achieved. In this respect, the amount is more preferably equal to or greater than 0.3 part by weight, and particularly preferably equal to or greater than 0.5 part by weight. By setting the amount to be equal to or less than 3.0 parts by weight, excellent feel at impact can be achieved. In this respect, the amount is more preferably equal to or less than 2.5 parts by weight.

Preferably, the rubber composition of the inner sphere 14 includes an organic sulfur compound. Illustrative examples of preferable organic sulfur compound include monosubstitution such as diphenyl disulfide, bis(4-chlorophenyl)disulfide, bis(3-chlorophenyl)disulfide, bis(4-bromophenyl)disulfide, bis(3-bromophenyl)disulfide, bis(4-fluorophenyl)disulfide, bis(4-iodophenyl)disulfide and bis(4-cyanophenyl)disulfide; disubstitution such as bis(2,5-dichlorophenyl)disulfide, bis(3,5-dichlorophenyl)disulfide, bis(2,6-dichlorophenyl)disulfide, bis(2,5-dibromophenyl)disulfide, bis(3,5-dibromophenyl)disulfide, bis(2-chloro-5-bromophenyl)disulfide and bis(2-cyano-5-bromophenyl)disulfide; trisubstitution such as bis(2,4,6-trichlorophenyl)disulfide and bis(2-cyano-4-chloro-6-bromophenyl)disulfide; tetrasubstitution such as bis(2,3,5,6-tetrachlorophenyl)disulfide; and pentasubstitution such as bis(2,3,4,5,6-pentachlorophenyl)disulfide and bis(2,3,4,5,6-pentabromophenyl)disulfide. The organic sulfur compound contributes to resilience performance. Particularly preferable organic sulfur compound is diphenyl disulfide and bis(pentabromophenyl)disulfide.

In light of resilience performance of the golf ball 2, the amount of the organic sulfur compound to be blended is preferably equal to or greater than 0.1 part by weight and more preferably equal to or greater than 0.2 part by weight per 100 parts by weight of the base rubber. In light of the soft feel at impact, the amount of the organic sulfur compound to be blended is preferably equal to or less than 1.5 parts by weight, more preferably equal to or less than 1.0 part by weight, and particularly preferably equal to or less than 0.8 part by weight per 100 parts by weight of the base rubber.

Into the inner sphere 14 may be blended a filler for the purpose of adjusting specific gravity and the like. Illustrative examples of suitable filler include zinc oxide, barium sulfate, calcium carbonate and magnesium carbonate. Powder of a highly dense metal may be blended as a filler. Specific examples of the highly dense metal include tungsten and molybdenum. The amount of the filler to be blended is determined ad libitum so that the intended specific gravity of the inner sphere 14 can be accomplished. Particularly preferable filler is zinc oxide. Zinc oxide serves not only to adjust the specific gravity but also as a crosslinking activator. Various kinds of additives such as sulfur, an anti-aging agent, a coloring agent, a plasticizer, a dispersant and the like may be blended at an adequate amount to the inner sphere 14 as needed. Into the inner sphere 14 may be also blended crosslinked rubber powder or synthetic resin powder.

The inner sphere 14 has a central hardness Hi of preferably 20 or greater and 45 or less. By the inner sphere 14 having the central hardness Hi of equal to or greater than 20, excellent resilience performance and light feel at impact can be achieved. In this respect, the central hardness Hi is more preferably equal to or greater than 24, and particularly preferably equal to or greater than 27. By the inner sphere 14 having the central hardness Hi of equal to or less than 45, excessive spin upon a shot with a driver can be suppressed. In this respect, the central hardness Hi is more preferably equal to or less than 42, still more preferably equal to or less than 41, yet more preferably equal to or less than 40 and particularly preferably equal to or less than 38. The central hardness Hi is measured by pressing a Shore D type hardness scale at a central point of a hemisphere obtained by cutting the inner sphere 14. For the measurement, an automated rubber hardness machine (trade name "LA1", available from Koubunshi Keiki Co., Ltd.) which is equipped with this hardness scale is used.

The inner sphere 14 has a surface hardness Hsi of preferably 30 or greater and 70 or less. By the inner sphere 14 having the surface hardness Hsi of equal to or greater than 30, excellent resilience performance can be achieved. In this respect, the surface hardness Hsi is more preferably equal to or greater than 40, and particularly preferably equal to or greater than 45. By the inner sphere 14 having the surface hardness Hsi of equal to or less than 70, excellent feel at impact can be achieved. In this respect, the surface hardness Hsi is more preferably equal to or less than 65, still more preferably equal to or less than 60 and particularly preferably equal to or less than 55. The surface hardness is measured by pressing the Shore D type hardness scale against the surface of the spherical body (inner sphere 14, center 10, core 4 or golf ball 2). For the measurement, the automated rubber hardness machine (trade name "LA1", available from Koubunshi Keiki Co., Ltd.) which is equipped with this hardness scale is used.

In light of achievement of both feel at impact and resilience performance, a difference (Hsi−Hi) between the surface hardness Hsi and the central hardness Hi is preferably equal to or greater than 10, more preferably equal to or greater than 15. The difference (Hsi−Hi) is preferably equal to or less than 30.

The amount of compressive deformation Di of the inner sphere 14 is preferably 2.5 mm or greater and 6.0 mm or less. By the inner sphere 14 having the amount of compressive deformation Di of equal to or greater than 2.5 mm, excellent feel at impact can be achieved. In this respect, the amount of compressive deformation Di is more preferably equal to or greater than 2.8 mm and particularly preferably equal to or greater than 3.0 mm. As described later, this golf ball 2 has a thin cover 8. Upon hitting of this golf ball 2, the inner sphere 14 is greatly deformed resulting from the cover 8 being thin. Owing to the inner sphere having the amount of compressive deformation Di of equal to or less than 6.0 mm, excellent resilience performance can be achieved. In this respect, the amount of compressive deformation Di is more preferably equal to or less than 5.5 mm, and particularly preferably equal to or less than 5.0 mm.

Upon measurement of the amount of compressive deformation, the spherical body (inner sphere 14, center 10, core 4 or golf ball 2) is first placed on a hard plate made of metal. Next, a cylinder made of metal gradually descends toward the spherical body. The spherical body intervened between the bottom face of the cylinder and the hard plate is deformed. A migration distance of the cylinder, starting from the state in which initial load of 98 N is applied to the spherical body up to the state in which final load of 1274 N is applied thereto is the amount of compressive deformation.

A diameter of the inner sphere 14 is preferably equal to or greater than 20 mm, more preferably equal to or greater than 24 mm, and particularly preferably equal to or greater than 25 mm. The diameter of the inner sphere 14 is preferably equal to or less than 36 mm, more preferably equal to or less than 35 mm, and particularly preferably equal to or less than 34 mm. Weight of the inner sphere 14 is preferably 25 g or greater and 40 g or less. Crosslinking temperature of the inner sphere 14 is usually 130° C. or greater and 180° C. or less. The crosslinking time period of the inner sphere 14 is usually 10 minutes or longer and 50 minutes or less.

The center outer layer 16 is formed by a composition including a thermosetting polymer as a base. Specifically, the outer layer 16 is obtained through crosslinking of a rubber composition. Preferable base rubber is equal to the base rubber of the inner sphere 14.

For the outer layer 16, a co-crosslinking agent which is equal to that of the inner sphere 14 is used. The amount of the co-crosslinking agent to be blended is preferably 20 parts by weight or greater and 50 parts by weight or less per 100 parts by weight of the base rubber. By setting the amount to be equal to or greater than 20 parts by weight, excellent resilience performance can be achieved. In this respect, the amount is more preferably equal to or greater than 35 parts by weight. By setting the amount to be equal to or less than 50 parts by weight, excellent feel at impact can be achieved. In this respect, the amount is more preferably equal to or less than 45 parts by weight.

Into the rubber composition of the outer layer 16, in the same way as the rubber composition of the inner sphere 14, an organic peroxide and an organic sulfur compound can be blended. Kinds and amount to be blended of the organic peroxide and kinds and amount to be blended of the organic sulfur compound are equal to those of the inner sphere 14. Into the rubber composition, a filler and an additive which are equal to those of the inner sphere 14 may be blended.

The outer layer 16 has a thickness To of preferably 2.0 mm or greater and 4.5 mm or less. The outer layer 16 with a thickness To of equal to or greater than 2.0 mm is responsible for resilience performance. In this respect, the thickness To is more preferably equal to or greater than 2.3 mm, still more preferably equal to or greater than 2.5 mm, yet more preferably equal to or greater than 2.7 mm, and particularly preferably equal to or greater than 3.0 mm. The outer layer 16 with the thickness To of equal to or less than 4.5 mm does not deteriorate feel at impact. In this respect, the thickness To is more preferably equal to or less than 4.3 mm, still more preferably equal to or less than 4.0 mm, yet more preferably equal to or less than 3.9 mm, and particularly preferably equal to or less than 3.6 mm.

The center 10 formed by the inner sphere 14 and the outer layer 16 has a surface hardness Hs1 of preferably 40 or greater and 80 or less. By the center 10 having the surface hardness Hs1 of equal to or greater than 40, excellent resilience performance can be achieved. In this respect, the surface hardness Hs1 is more preferably equal to or greater than 50, and particularly preferably equal to or greater than 55. By the center 10 having the surface hardness Hs1 of equal to or less than 80, excellent feel at impact can be achieved. In this respect, the surface hardness Hs1 is more preferably equal to or less than 70, and particularly preferably equal to or less than 65.

In light of achievement of both feel at impact and resilience performance, a difference (Hs1−Hi) between the surface hardness Hs1 and the central hardness Hi is preferably equal to or greater than 20, more preferably equal to or greater than 25. The difference (Hs1−Hi) is preferably equal to or less than 40.

A difference (Hs1−Hsi) between the surface hardness Hs1 of the center 10 and the surface hardness Hsi of the inner sphere 14 is preferably equal to or greater than 1. In the center 10, mainly the inner sphere 14 is responsible for feel at impact and mainly the outer layer 16 is responsible for resilience performance. In this respect, the difference (Hs1−Hsi) is more preferably equal to or greater than 2, still more preferably equal to or greater than 3, yet more preferably equal to or greater than 5, and particularly preferably equal to or greater than 8. The difference (Hs1−Hsi) is preferably equal to or less than 20, and more preferably equal to or less than 15.

The amount of compressive deformation D1 of the center 10 is preferably 2.0 mm or greater and 5.0 mm or less. By the center 10 having the amount of compressive deformation D1 of equal to or greater than 2.0 mm, excellent feel at impact can be achieved. In this respect, the amount of compressive deformation D1 is more preferably equal to or greater than 2.4 mm, still more preferably equal to or greater than 2.7 mm, yet more preferably equal to or greater than 2.8 mm, and particularly equal to or greater than 2.9 mm. As described later, this golf ball 2 has a thin cover 8. Upon hitting of this golf ball 2, the center 10 is greatly deformed resulting from the cover 8 being thin. Owing to the center 10 having the amount of compressive deformation D1 of equal to or less than 5.0 mm, excellent resilience performance can be achieved. In this respect, the amount of compressive deformation D1 is more preferably equal to or less than 4.5 mm, still more preferably equal to or less than 4.0 mm, yet more preferably equal to or less than 3.6 mm, and particularly preferably equal to or less than 3.4 mm.

The center 10 has a diameter of preferably equal to or greater than 27 mm, more preferably equal to or greater than 28 mm, and particularly preferably equal to or greater than 30 mm. The center 10 has a diameter of preferably equal to or less than 42 mm, more preferably equal to or less than 41 mm, and still more preferably equal to or less than 40 mm. Weight of the center 10 is preferably 30 g or greater and 45 g or less.

On production of the center 10, half shells are molded from a rubber composition for the outer layer. By two pieces of the half shells, the inner sphere 14 in half cross-linked condition is covered. The inner sphere 14 and the half shells are compressed and heated in a mold to obtain the center 10.

For the mid layer 12, a thermoplastic resin composition is suitably used. Examples of the base polymer of this resin composition include ionomer resins, thermoplastic polyester elastomers, thermoplastic polyamide elastomers, thermoplastic polyurethane elastomers, thermoplastic polyolefin elastomers and thermoplastic polystyrene elastomers. In particular, ionomer resins are preferred. The ionomer resins are highly elastic. As described later, this golf ball 2 has a thin cover 8. Upon hitting of this golf ball 2, the mid layer 12 is greatly deformed resulting from the cover 8 being thin. The mid layer 12 including the ionomer resin is responsible for the resilience performance.

The ionomer resin and other resin may be used in combination. When they are used in combinaiton, the ionomer resin is included as the principal component of the base polymer, in light of the resilience performance. Proportion of the ionomer resin in the total base polymer accounts for preferably equal to or greater than 50% by weight, more preferably equal to or greater than 70% by weight, and particularly preferably equal to or greater than 85%.

Examples of preferred ionomer resin include binary copolymers formed with α-olefin and an α,β-unsaturated carboxylic acid having 3 to 8 carbon atoms. Preferable binary copolymer comprises 80% by weight or more and 90% by weight or less α-olefin, and 10% by weight or more and 20% by weight or less α,β-unsaturated carboxylic acid. This binary copolymer provides excellent resilience performance. Examples of preferable other ionomer resin include ternary copolymers formed with α-olefin, an α,β-unsaturated carboxylic acid having 3 to 8 carbon atoms and an α,β-unsaturated carboxylate ester having 2 to 22 carbon atoms. Preferable ternary copolymer comprises 70% by weight or more and 85% by weight or less α-olefin, 5% by weight or more and 30% by weight or less α,β-unsaturated carboxylic acid, and 1% by weight or more and 25% by weight or less α,β-unsaturated carboxylate ester. This ternary copolymer provides excellent resilience performance. In the binary copolymer and ternary copolymer, preferable α-olefin may be ethylene and propylene, while preferable α,β-unsaturated carboxylic acid may be acrylic acid and methacrylic acid. Particularly preferred ionomer resin is a copolymer formed with ethylene, and acrylic acid or methacrylic acid.

In the binary copolymer and ternary copolymer, a part of the carboxyl group may be neutralized with a metal ion. Illustrative examples of the metal ion for use in neutralization include sodium ion, potassium ion, lithium ion, zinc ion, calcium ion, magnesium ion, aluminum ion and neodymium ion. The neutralization may be carried out with two or more kinds of metal ions. Particularly suitable metal ion in light of the resilience performance and durability of the golf ball 2 is sodium ion, zinc ion, lithium ion and magnesium ion.

Specific examples of the ionomer resin include trade names "Himilan 1555", "Himilan 1557", "Himilan 1605", "Himilan 1706", "Himilan 1707", "Himilan 1856", "Himilan 1855", "Himilan AM7311", "Himilan AM7315", "Himilan AM7317", "Himilan AM7318", "Himilan AM7329" and "Himilan MK7320", available from Du Pont-MITSUI POLYCHEMICALS Co., Ltd.; trade names "Surlyn® 6120", "Surlyn® 6910", "Surlyn® 7930", "Surlyn® 7940", "Surlyn® 8140", "Surlyn® 8150", "Surlyn® 8940", "Surlyn® 8945", "Surlyn® 9120", "Surlyn® 9150", "Surlyn® 9910", "Surlyn® 9945" and "Surlyn® AD8546", available from Dupont; and trade names "IOTEK 7010", "IOTEK 7030", "IOTEK 7510", "IOTEK 7520", "IOTEK 8000" and "IOTEK 8030", available from EXXON Mobil Chemical Corporation. Two or more kinds of the ionomer resin may be used in combination. An ionomer resin neutralized with a monovalent metal ion, and an ionomer resin neutralized with a bivalent metal ion may be used in combination.

Into the resin composition of the mid layer 12 may be blended a filler for the purpose of adjusting specific gravity and the like. Illustrative examples of suitable filler include zinc oxide, barium sulfate, calcium carbonate and magnesium carbonate. Powder of a highly dense metal may be also blended as the filler. Specific examples of the highly dense metal include tungsten and molybdenum. The amount of the filler to be blended is determined ad libitum so that intended specific gravity of the mid layer 12 can be accomplished. Into the mid layer 12 may be also blended a coloring agent, crosslinked rubber powder or synthetic resin powder.

The mid layer 12 has a hardness Hm of 55 or greater and 72 or less. By the mid layer 12 having the hardness Hm of equal to or greater than 55, excellent resilience performance can be achieved. In addition, with the mid layer 12 having the hardness Hm of equal to or greater than 55, a core 4 having a hard outside and a soft inside can be attained. This core 4 is responsible for suppression of the spin upon a shot with a driver. In these respects, the hardness Hm is more preferably equal to or greater than 58, and particularly preferably equal to or greater than 60. By the mid layer 12 having the hardness Hm of equal to or less than 72, excellent feel at impact can be achieved. In this respect, the hardness Hm is more preferably equal to or less than 70, and particularly preferably equal to or less than 68. Preferably, a peak in a hardness curve from the center point of the inner sphere 14 to the surface of the cover 8 is attained in the mid layer 12.

In the present invention, the hardness Hm of the mid layer 12 and the hardness Hc of the cover 8 may be measured in accordance with a standard of "ASTM-D 2240-68". For the measurement, an automated rubber hardness machine which is equipped with a Shore D type hardness scale (trade name "LA1", available from Koubunshi Keiki Co., Ltd.) is used. For the measurement, a sheet which was formed by hot press, has a thickness of about 2 mm and consists of the same material as that of the mid layer 12 (or the cover 8) is used. Prior to the measurement, the sheet is stored at a temperature of 23° C. for two weeks. When the measurement is carried out, three sheets are overlaid.

The mid layer 12 has a thickness Tm of preferably 0.2 mm or greater and 2.5 mm or less. By the mid layer 12 having the thickness Tm of equal to or greater than 0.2 mm, excellent resilience performance can be achieved. In this respect, the thickness Tm is more preferably equal to or greater than 0.5 mm, still more preferably equal to or greater than 0.7 mm, and particularly preferably equal to or greater than 1.2 mm. The mid layer 12 having the thickness Tm of equal to or less than 2.5 mm does not deteriorate feel at impact. In this respect, the thickness Tm is more preferably equal to or less than 2.1 mm, still more preferably equal to or less than 2.0 mm, and particularly preferably equal to or less than 1.8 mm.

The core 4 including the center 10 and the mid layer 12 has a surface hardness Hs2 of 50 or greater and 85 or less. By the core 4 having the surface hardness Hs2 of equal to or greater than 50, excellent resilience performance can be achieved. In this respect, the surface hardness Hs2 is more preferably equal to or greater than 55, and particularly preferably equal to or greater than 60. The core 4 having the surface hardness Hs2 of equal to or less than 85 does not deteriorate feel at impact. In this respect, the surface hardness Hs2 is more preferably equal to or less than 80, and particularly preferably equal to or less than 75.

The amount of compressive deformation D2 of the core 4 is preferably 1.8 mm or greater and 4.0 mm or less. By the core 4 having the amount of compressive deformation D2 of equal to or greater than 1.8 mm, excellent feel at impact can be achieved. In this respect, the amount of compressive deformation D2 is more preferably equal to or greater than 2.0 mm, still more preferably equal to or greater than 2.1 mm, yet more preferably equal to or greater than 2.2 mm, and particularly preferably equal to or greater than 2.3 mm. As described later, this golf ball 2 has a thin cover 8. Upon hitting of this golf ball 2, the core 4 is greatly deformed resulting from the cover 8 being thin. Owing to the core 4 having the amount of compressive deformation D2 of equal to or less than 4.0 mm, excellent resilience performance can be achieved. In this respect, the amount of compressive deformation D2 is more preferably equal to or less than 3.7 mm, and particularly preferably equal to or less than 3.4 mm.

In light of adhesion between the core 4 and the reinforcing layer 6 or the cover 8, the surface of the core 4 is preferably subjected to a treatment, whereby the roughness thereof is increased. Specific examples of the treatment include brushing, grinding and the like.

The reinforcing layer 6 lies between the mid layer 12 and the cover 8, and improves adhesiveness therebetween. As described later, this golf ball 2 has an extremely thin cover 8. When such a thin cover 8 is hit with an edge of a clubface, a wrinkle is liable to be generated. The reinforcing layer 6 suppresses generation of such a wrinkle.

For the base polymer of the reinforcing layer 6, a two-component cured thermosetting resin may be suitably used. Specific examples of the two-component cured thermosetting resin include epoxy resins, urethane resins, acrylic resins, polyester based resins and cellulose based resins. In light of the feature (e.g., strength at break) and durability of the reinforcing layer 6, two-component cured epoxy resins and two-component cured urethane resins are preferred.

The two-component cured epoxy resin is obtained by curing an epoxy resin with a polyamide based curing agent. Illustrative examples of the epoxy resin for use in the two-component cured epoxy resin include bisphenol A type epoxy resins, bisphenol F type epoxy resins and bisphenol AD type epoxy resins. The bisphenol A type epoxy resin is obtained by a reaction of bisphenol A with an epoxy group-containing compound such as epichlorohydrin. The bisphenol F type epoxy resin is obtained by a reaction of bisphenol F with an epoxy group-containing compound. The bisphenol AD type epoxy resin is obtained by a reaction of bisphenol AD with an epoxy group-containing compound. In light of the balance among softness, chemical resistance, heat resistance and toughness, the bisphenol A type epoxy resins are preferred.

The polyamide based curing agent has multiple amino groups and one or more amide groups. This amino group can react with an epoxy group. Specific examples of the polyamide based curing agent include polyamide amine curing agents and modified products of the same. The polyamide amine curing agent is obtained by a condensation reaction of a polymerized fatty acid with a polyamine. Typical polymerized fatty acid may be obtained by heating natural fatty acids containing a large amount of an unsaturated fatty acid such as linoleic acid, linolenic acid or the like in the presence of a catalyst to perfect the synthesis. Specific examples of the unsaturated fatty acid include tall oil, soybean oil, linseed oil and fish oil. Polymerized fatty acids having a dimer content of equal to or greater than 90% by weight and a trimer content of equal to or less than 10% by weight, and being hydrogenated are preferred. Illustrative examples of preferred polyamine include polyethylene diamine, polyoxyalkylene diamine and derivatives thereof.

Upon mixing of the epoxy resin and the polyamide based curing agent, ratio of epoxy equivalent of the epoxy resin and amine active hydrogen equivalent of the polyamide based curing agent is preferably 1.0/1.4 or greater and 1.0/1.0 or less.

The two-component cured urethane resin is obtained by a reaction of a base material and a curing agent. A two-component cured urethane resin obtained by a reaction of a base material containing a polyol component with a curing agent containing polyisocyanate or a derivative thereof, or a two-component cured urethane resin obtained by a reaction of a base material containing an isocyanate group-ended urethane prepolymer with a curing agent having an active hydrogen may be used. In particular, two-component cured urethane resins obtained by a reaction of a base material containing a polyol component with a curing agent containing polyisocyanate or a derivative thereof are preferred.

It is preferred that urethane polyol is used as the polyol component of the base material. The urethane polyol has urethane bonds and at least two hydroxyl groups. Preferably, the urethane polyol has a hydroxyl group at its end. The urethane polyol may be obtained by allowing polyol and polyisocyanate to react at a ratio such that an excessive molar ratio of the hydroxyl group of the polyol component to the isocyanate group of polyisocyanate is attained.

The polyol for use in production of the urethane polyol has multiple hydroxyl groups. Polyol having a weight average molecular weight of 50 or greater and 2000 or less, and particularly 100 or greater and 1000 or less is preferred. Examples of the polyol having a low molecular weight include diol and triol. Specific examples of the diol include ethylene glycol, diethylene glycol, triethylene glycol, 1,3-butanediol, 1,4-butanediol, neopentyl glycol and 1,6-hexanediol. Specific examples of the triol include trimethylolpropane and hexanetriol. Examples of the polyol having a high molecular weight include polyether polyols such as polyoxyethylene glycol (PEG), polyoxypropylene glycol (PPG) and polyoxytetramethylene glycol (PTMG); condensed polyester polyols such as polyethylene adipate (PEA), polybutylene adipate (PBA) and polyhexamethylene adipate (PHMA); lactone based polyester polyols such as poly-ε-caprolactone (PCL); polycarbonate polyols such as polyhexamethylene carbonate; and acrylic polyols. Two or more kinds of the polyol may be used in combination.

Polyisocyanate for use in production of urethane polyol has multiple isocyanate groups. Specific examples of the polyisocyanate include aromatic polyisocyanates such as 2,4-toluene diisocyanate, 2,6-toluene diisocyanate, mixtures of 2,4-toluene diisocyanate and 2,6-toluene diisocyanate (TDI), 4,4'-diphenylmethanediisocyanate (MDI), 1,5-naphthylene diisocyanate (NDI), 3,3'-bitolylene-4,4'-diisocyanate (TODI), xylylene diisocyanate (XDI), tetramethylxylylene diisocyanate (TMXDI) and paraphenylene diisocyanate (PPDI); alicyclic polyisocyanates such as 4,4'-dicyclohexylmethane diisocyanate ($H_{12}$MDI), hydrogenated xylylene diisocyanate ($H_6$XDI), hexamethylene diisocyanate (HDI) and isophorone diisocyanate (IPDI); and aliphatic polyisocyanates. Two or more polyisocyanates may be used in combination. In light of the weather resistance, TMXDI, XDI, HDI, $H_6$XDI, IPDI and $H_{12}$MDI are preferred.

In the reaction of polyol and polyisocyanate for producing the urethane polyol, any known catalyst may be used. Typical catalyst may be dibutyltin dilaurate.

In light of strength of the reinforcing layer 6, ratio of the urethane bonds included in the urethane polyol is preferably equal to or greater than 0.1 mmol/g. In light of the following capability of the reinforcing layer 6 to the cover 8, the ratio of the urethane bonds included in the urethane polyol is preferably equal to or less than 5 mmol/g. The ratio of the urethane bonds may be adjusted by regulating the molecular weight of the polyol to be a raw material, and by regulating compounding ratio of the polyol and the polyisocyanate.

In light of a short time period required for the reaction of the base material with the curing agent, the urethane polyol has a weight average molecular weight of preferably equal to or greater than 4000, and more preferably equal to or greater than 4500. In light of the adhesiveness of the reinforcing layer 6, the urethane polyol has a weight average molecular weight of preferably equal to or less than 10000, and more preferably equal to or less than 9000.

In light of the adhesiveness of the reinforcing layer 6, the urethane polyol has a hydroxyl value (mgKOH/g) of preferably equal to or greater than 15, and more preferably equal to or greater than 73. In light of a short time period required for the reaction of the base material with the curing agent, the urethane polyol has a hydroxyl value of preferably equal to or less than 130, and more preferably equal to or less than 120.

The base material may contain, in addition to the urethane polyol, a polyol not having any urethane bond. The aforementioned polyol that is a raw material of the urethane polyol may be used in the base material. Polyols that are miscible with the urethane polyol are preferred. In light of a short time period required for the reaction of the base material with the curing agent, proportion of the urethane polyol in the base material is preferably equal to or greater than 50% by weight and more preferably equal to or greater than 80% by weight based on the solid content. Ideally, this proportion is 100% by weight.

The curing agent contains polyisocyanate or a derivative thereof. The aforementioned polyisocyanate that is a raw material of the urethane polyol may be used in the curing agent.

The reinforcing layer 6 may include additives such as a coloring agent (typically, titanium dioxide), a phosphate based stabilizer, an antioxidant, a light stabilizer, a fluorescent brightening agent, an ultraviolet absorbent, a blocking preventive agent and the like. The additive may be added either to the base material of the two-component cured thermosetting resin, or to the curing agent.

The reinforcing layer 6 is obtained by coating a liquid, which is prepared by dissolving or dispersing a base material and a curing agent in a solvent, on the surface of the mid layer 12. In light of the workability, coating with a spray gun is preferred. The solvent is volatilized after the coating to permit a reaction of the base material with the curing agent thereby forming the reinforcing layer 6. Illustrative examples of preferred solvent include toluene, isopropyl alcohol, xylene, methyl ethyl ketone, methyl isobutyl ketone, ethylene glycol monomethyl ether, ethylbenzene, propylene glycol monomethyl ether, isobutyl alcohol and ethyl acetate.

In light of suppression of the wrinkle, the reinforcing layer 6 has a thickness Tr of preferably equal to or greater than 3 μm, and more preferably equal to or greater than 5 μm. In light of easy formation of the reinforcing layer 6, it is preferred that the thickness Tr is equal to or less than 300 μm, still more, equal to or less than 100 μm, yet more, equal to or less than 50 μm, and further, equal to or less than 20 μm. The thickness Tr is measured by observation of the cross section of the golf ball 2 with a micro scope. When the surface of the mid layer 12 has roughness resulting from the surface roughening treatment, the thickness is measured immediately above the protruded portion.

In light of suppression of the wrinkle, the reinforcing layer 6 has a pencil hardness of preferably equal to or greater than 4B, and more preferably equal to or greater than B. In light of small loss of the force during transfer from the cover 8 to the mid layer 12 upon hitting of the golf ball 2, the reinforcing layer 6 has a pencil hardness of preferably equal to or less than 3H. The pencil hardness is measured in accordance with a standard of "JIS K5400".

When sufficient adhesion between the mid layer 12 and the cover 8 is accomplished leading to less possibility to generate the wrinkle, the reinforcing layer 6 may not be provided.

A thermoplastic resin composition is suitably used for the cover 8. Examples of base polymer of this resin composition include thermoplastic polyurethane elastomers, thermoplastic polyester elastomers, thermoplastic polyamide elastomers, thermoplastic polyolefin elastomers, thermoplastic polystyrene elastomers and ionomer resins. In particular, thermoplastic polyurethane elastomers are preferred. The thermoplastic polyurethane elastomers are soft. Great spin rate is achieved upon hitting the golf ball 2 having a cover 8 comprising a thermoplastic polyurethane elastomer, with a short iron. The cover 8 comprising a thermoplastic polyurethane elastomer is responsible for a control performance upon a shot with a short iron. The thermoplastic polyurethane elastomer is also responsible for the scuff resistance of the cover 8. Furthermore, by the thermoplastic polyurethane elastomer, excellent feel at impact can be achieved upon hitting with a putter or a short iron.

Other resin may be used in combination with the thermoplastic polyurethane elastomer. In light of the control performance, the thermoplastic polyurethane elastomer is included in the base polymer as a principal component in the case of use in combination. Proportion of the thermoplastic polyurethane elastomer to total base polymer is preferably equal to or greater than 50% by weight, more preferably equal to or greater than 70% by weight, and particularly preferably equal to or greater than 85% by weight.

The thermoplastic polyurethane elastomer includes a polyurethane component as a hard segment, and a polyester component or a polyether component as a soft segment. Illustrative examples of the curing agent for the polyurethane component include alicyclic diisocyanate, aromatic diisocyanate and aliphatic diisocyanate. In particular, alicyclic diisocyanate is preferred. Because the alicyclic diisocyanate has no double bond in the main chain, yellowing of the cover 8 can be suppressed. Additionally, because the alicyclic diisocyanate is excellent in strength, the cover 8 can be prevented from being scuffed. Two or more kinds of the diisocyanate may be used in combination.

Illustrative examples of the alicyclic diisocyanate include 4,4'-dicyclohexylmethane diisocyanate ($H_{12}MDI$), 1,3-bis (isocyanatomethyl)cyclohexane ($H_6XDI$), isophorone diisocyanate (IPDI) and trans-1,4-cyclohexane diisocyanate (CHDI). In light of versatility and processability, $H_{12}MDI$ is preferred.

Illustrative examples of the aromatic diisocyanate include 4,4'-diphenylmethane diisocyanate (MDI) and toluene diisocyanate (TDI). Illustrative examples of the aliphatic diisocyanate include hexamethylene diisocyanate (HDI).

Thermoplastic polyurethane elastomers having a material hardness of equal to or less than 50, still more, equal to or less than 45, yet more, equal to or less than 38, and further, equal to or less than 34 are preferred. By such an elastomer, small hardness Hc of the cover 8 can be attained. In light of suppression of excessive spin, the material hardness is preferably equal to or greater than 20, and more preferably equal to or greater than 26. For the measurement of the material hardness, a sheet consisting of the polymer alone may be used. The measuring method is the same as the measuring method of the hardness Hm of the mid layer 12.

Specific examples of the thermoplastic polyurethane elastomer include trade names "Elastollan XNY80A", "Elastollan XNY85A", "Elastollan XNY90A", "Elastollan XNY97A", "Elastollan XNY585" and "Elastollan XKP016N", available from BASF Japan Ltd; and trade name "Rezamin P4585LS" and "Rezamin PS62490", available from Dainichiseika Color & Chemicals Mfg. Co., Ltd. In light of possible achievement of small hardness Hc, "Elastollan XNY80A", "Elastollan XNY85A" and "Elastollan XNY90A" are particularly preferred.

Into the cover 8 may be blended a coloring agent such as titanium dioxide, a filler such as barium sulfate, a dispersant, an antioxidant, an ultraviolet absorbent, alight stabilizer, a fluorescent agent, a fluorescent brightening agent and the like in an appropriate amount as needed. Also, the cover 8 may be blended with powder of a highly dense metal such as tungsten, molybdenum or the like for the purpose of adjusting the specific gravity.

The cover 8 has a hardness Hc of preferably 15 or greater and 50 or less. By the cover 8 having the hardness Hc of equal to or greater than 15, the spin upon a shot with a driver can be suppressed. This cover 8 can be responsible for the flight distance attained by the shot with a driver. In this respect, the hardness Hc is more preferably equal to or greater than 20, still more preferably equal to or greater than 23, yet more preferably equal to or greater than 25, and particularly preferably equal to or greater than 26. By the cover 8 having the hardness Hc of equal to or less than 50, a great spin rate can be achieved upon a shot with a short iron. In this respect, the hardness Hc is more preferably equal to or less than 45, and particularly preferably equal to or less than 40.

The cover 8 has a thickness Tc of preferably equal to or less than 1.0 mm. As described above, the cover 8 is soft. The soft cover 8 is disadvantageous in terms of resilience coefficient of the golf ball 2. Upon a shot with a driver, the core 4 of the golf ball 2 is also deformed greatly. By setting the thickness Tc to be equal to or less than 1.0 mm, the cover 8 does not adversely affect the resilience coefficient to a large extent upon a shot with a driver, even though the cover 8 is soft. An excellent flight performance can be achieved upon a shot with a driver through using the ionomer resin in the mid layer 12.

In light of the flight performance, the thickness Tc is more preferably equal to or less than 0.8 mm, still more preferably equal to or less than 0.5 mm, and particularly preferably equal to or less than 0.4 mm. In light of inhibition of attaining too small spin rate, the thickness Tc is preferably equal to or greater than 0.1 mm, and more preferably equal to or greater than 0.2 mm.

The product (Tc·Hc) of the thickness Tc (mm) of the cover 8 and the hardness Hc of the cover 8 is preferably equal to or less than 25. The product (Tc·Hc) is an index which shows an influence of the cover 8 on a deformation behavior of the golf ball 2. The smaller the thickness Tc is, the smaller product (Tc·Hc) is obtained. The smaller the hardness Hc is, the smaller product (Tc·Hc) is obtained. The cover 8 having the product (Tc·Hc) of equal to or less than 25 is extremely thin and extremely soft. Upon hitting the golf ball 2 with a short iron, this cover 8 is sufficiently deformed irrespective of the thickness Tc being small. Due to this deformation, a long period of time of contact between the face of the short iron and the golf ball 2 can be achieved. The long period of time of contact results in a great spin rate. The long period of time of contact can also suppress variance of the spin rate. In addition, this cover 8 can also achieve an excellent scuff resistance performance. Moreover, by this cover 8, excellent feel at impact upon hitting with a putter or a short iron can be achieved. As the cover 8 is thin, the cover 8 does not deteriorate resilience performance when the golf ball 2 is hit with a driver irrespective of the hardness Hc being small. The golf ball 2 is excellent in spin performance, spin stability, scuff resistance performance, feel at impact and resilience performance.

The product (Tc·Hc) is more preferably equal to or less than 23, and particularly preferably equal to or less than 20. In light of suppression of excessive spin upon a shot with a driver, the product (Tc·Hc) is preferably equal to or greater than 5, and particularly preferably equal to or greater than 10.

The cover 8 has a hardness Hc being smaller than the central hardness Hi of the inner sphere 14. Upon hitting the golf ball 2 with a short iron, sufficient spin is attained. The golf ball 2 having the hardness Hc being smaller than the central hardness Hi is excellent in control performance. Preferably, a smallest value in a hardness curve from the center point of the golf ball 2 to the surface of the cover 8 is attained in the cover 8.

In light of the spin performance, scuff resistance performance and feel at impact, the difference (Hi−Hc) between the central hardness Hi of the inner sphere 14 and the hardness Hc of the cover 8 is preferably equal to or greater than 1, more preferably equal to or greater than 2, and particularly preferably equal to or greater than 5. The difference (Hi−Hc) is preferably equal to or less than 30, and particularly preferably equal to or less than 25.

The amount of compressive deformation D3 of the golf ball 2 is preferably 2.20 mm or greater and 2.90 mm or less. The golf ball 2 having the amount of compressive deformation D3 of equal to or greater than 2.20 mm is excellent in feel at impact. In this respect, the amount of compressive deformation D3 is more preferably equal to or greater than 2.25 mm, and particularly preferably equal to or greater than 2.30 mm. The golf ball 2 having the amount of compressive deformation D3 of equal to or less than 2.90 mm is excellent in the resilience performance. In this respect, the amount of compressive deformation D3 is more preferably equal to or less than 2.85 mm, and particularly preferably equal to or less than 2.80 mm.

The golf ball 2 according to the present invention, the difference between the amount of compressive deformation D3 and the amount of compressive deformation D2 is small. In other words, the ratio (D2/D3) is close to 1.00. The ratio (D2/D3) is an index which depends on thickness and hardness Hc of the cover 8. In the golf ball 2 having the ratio (D2/D3) being close to 1.00, an influence of the cover 8 on the amount of compressive deformation D3 is small. In the golf ball 2 having the ratio (D2/D3) being close to 1.00, the cover 8 is thin and the hardness Hc of the cover 8 is small. When the golf ball 2 having the ratio (D2/D3) being close to 1.00 is hit with a short iron, the cover 8 is sufficiently deformed irrespective of the thickness Tc being small. Due to this deformation, a long period of time of contact between the face of the short iron and the golf ball 2 can be achieved. The long period of time of contact results in a great spin rate. The long period of time of contact can also suppress variance of the spin rate. In addition, this cover 8 can also achieve an excellent scuff resistance performance. Moreover, by this cover 8, excellent feel at impact upon hitting with a putter or a short iron can be achieved. As the cover 8 is thin, when the golf ball 2 is hit with a driver, the cover 8 does not deteriorate resilience performance irrespective of the hardness Hc being small. The golf ball 2 is excellent in spin performance, spin stability, scuff resistance performance, feel at impact and resilience performance.

The ratio (D2/D3) is preferably 0.98 or greater and 1.10 or less. When the golf ball 2 having the ratio (D2/D3) of equal to or greater than 0.98 is hit with a driver, excessive spin is not caused. In this respect, the ratio (D2/D3) is more preferably equal to or greater than 0.99, and particularly preferably equal to or greater than 1.00. The golf ball 2 having the ratio (D2/D3) of equal to or less than 1.10 is excellent in the spin performance and spin stability upon a shot with a short iron. In this respect, the ratio (D2/D3) is more preferably equal to or less than 1.08, still more preferably equal to or less than 1.07, and particularly preferably equal to or less than 1.05.

EXAMPLES

[Experiment 1]

Example 1

A rubber composition was obtained by kneading 100 parts by weight of polybutadiene (trade name "BR-730", available from JSR Corporation), 26 parts by weight of zinc diacrylate (trade name "ZN-DA90S", available from Nippon Shokubai Co., Ltd.), 5.0 parts by weight of zinc oxide (trade name "zinc oxide type II", available from MITSUI MINING & SMELTING CO., LTD.), an appropriate amount of barium sulfate, 0.5 part by weight of diphenyldisulfide (manufactured by Sumitomo Seika Chemicals Co., Ltd.) and 0.9 part by weight of dicumyl peroxide (manufactured by NOF Corporation). This rubber composition was placed into a mold having upper and lower mold half each having a hemispherical cavity, and heated under a temperature of 170° C. for 15 minutes to obtain an inner sphere having a diameter of 32.4 mm.

A rubber composition was obtained by kneading 100 parts by weight of polybutadiene (trade name "BR-11", available from JSR Corporation), 40 parts by weight of zinc diacrylate (the aforementioned trade name "ZN-DA90S"), 5.0 parts by weight of zinc oxide (the aforementioned trade name "zinc oxide type II"), 10 parts by weight of barium sulfate, 0.5 part by weight of diphenyl disulfide (manufactured by Sumitomo Seika Chemicals Co., Ltd.) and 0.9 part by weight of dicumyl peroxide (manufactured by NOF Corporation). With the rubber composition, half shells were manufactured. The inner sphere was covered with two pieces of the half shells. The inner sphere together with the half shells were placed into a mold having upper and lower mold half each having a hemispherical cavity, and heated under a temperature of 170° C. for 15 minutes to obtain a center. The center had a diameter of 39.0 mm. The center is formed by the center inner sphere and an center outer layer. The outer layer had a thickness of 3.3 mm.

A resin composition was obtained by kneading 50 parts by weight of an ionomer resin (the aforementioned "Himilan 1605"), 50 parts by weight of other ionomer resin (the aforementioned "Surlyn® 9945"), 4 parts by weight of titanium dioxide, and 0.1 part by weight of ultramarine blue in a biaxial extruder. This resin composition was rendered to cover around the center by injection molding to obtain a core. The core had a diameter of 42.2 mm. The core is formed by the center and a mid layer. The mid layer had a thickness Tm of 1.6 mm.

A coating composition containing a two-component cured epoxy resin as a base polymer (trade name "POLIN 750LE", available from Shinto Paint Co., Ltd.) was prepared. The base material liquid of this coating composition consists of 30 parts by weight of a bisphenol A type solid epoxy resin and 70 parts by weight of a solvent. The curing agent liquid of this coating composition consists of 40 parts by weight of denatured polyamide amine, 55 parts by weight of a solvent and 5 parts by weight of titanium dioxide. Weight ratio of the base material liquid and the curing agent liquid is 1/1. This coating composition was coated on the surface of the mid layer with a spray gun, and kept in an atmosphere of 40° C. for 24 hours to give a reinforcing layer. This reinforcing layer had a thickness Tr of 10 μm.

A resin composition was obtained by kneading 100 parts by weight of a thermoplastic polyurethane elastomer (the aforementioned "Elastollan XNY80A"), 4 parts by weight of titanium dioxide, and 0.1 part by weight of ultramarine blue in a biaxial extruder. Half shells were obtained from this resin composition with compression molding. The core was covered by two pieces of the half shell, which was placed into a mold having upper and lower mold half each having a hemispherical cavity to obtain a cover with compression molding. The cover had a thickness Tc of 0.3 mm. A paint layer was formed around this cover to give a golf ball of Example 1. This golf ball had a diameter of 42.8 mm, and a weight of 45.5 g.

Examples 2 to 11 and Comparative Examples 1 to 5

In a similar manner to Example 1 except that the quality of the materials, the diameter of the inner sphere and the thickness Tc of the cover were as listed in Tables 1 to 6 below, golf balls of Examples 2 to 11 and Comparative Examples 1 to 5 were obtained.

[Shot with Driver]

A driver with a metal head was attached to a swing machine available from Golf Laboratory Co. Then the golf balls were hit under a condition to give the head speed of 50 m/sec. The ball speed and spin rate immediately after the hitting, and travel distance (i.e., the distance from the launching point to the point where the ball stopped) were measured. Mean values of 10 times measurement are shown in Tables 4 to 6 below.

[Shot with Short Iron]

To the swing machine described above was attached an approach wedge. Then the machine condition was set to give the head speed of 21 m/sec, and the golf balls were hit therewith. Accordingly, spin rate immediately after the hitting was measured. Mean values of 10 times measurement were determined. Moreover, the difference between maximum value and minimum value among the ten measurements was calculated, and rating was performed based on the following criteria:

A: the difference being less than 100 rpm;

B: the difference being 100 rpm or greater and less than 200 rpm; and

C: the difference being 200 rpm or greater.

The results are shown in the following Tables 4 to 6.

[Evaluation of Feel at Impact]

Using a driver, the golf balls were hit by a high class golf player. Then, the golf player rated the feel at impact based on the following criteria:

A: satisfactory with a less impact shock;

B: average; and

C: unsatisfactory with a great impact shock.

The results are shown in the following Tables 4 to 6.

[Evaluation of Scuff Resistance Performance]

To the swing machine described above was attached a pitching wedge. Then the machine condition was set to give the head speed of 36 m/sec, and the golf balls were hit therewith. Accordingly, the surface of this golf ball was visually observed, and rating was performed based on the following criteria:

A: scuff mark hardly found;

B: scuff mark, and raising found; and

C: great scuff mark found, and raising being prominent.

The results are shown in the following Tables 4 to 6.

TABLE 1

| | | Composition | | | | | |
|---|---|---|---|---|---|---|---|
| | | Example 1 | Example 2 | Example 3 | Example 4 | Example 5 | Example 6 |
| Center inner sphere | Polybutadiene | 100 | 100 | 100 | 100 | 100 | 100 |
| | Zinc diacrylate | 26.0 | 26.0 | 26.0 | 27.5 | 26.0 | 26.0 |
| | Zinc oxide | 5.0 | 5.0 | 5.0 | 5.0 | 5.0 | 5.0 |
| | Barium sulfate | appropriate amount | appropriate amount | appropriate amount | appropriate amount | appropriate amount | appropriate amount |
| | Diphenyl disulfide | 0.5 | 0.5 | 0.5 | 0.5 | 0.5 | 0.5 |
| | Dicumyl peroxide | 0.9 | 0.9 | 0.9 | 0.9 | 0.9 | 0.9 |
| Center outer layer | Polybutadiene | 100 | 100 | 100 | 100 | 100 | 100 |
| | Zinc diacrylate | 40.0 | 40.0 | 40.0 | 40.0 | 40.0 | 40.0 |
| | Zinc oxide | 5.0 | 5.0 | 5.0 | 5.0 | 5.0 | 5.0 |
| | Barium sulfate | 10.0 | 10.0 | 10.0 | 10.0 | 10.0 | 10.0 |
| | Diphenyl disulfide | 0.5 | 0.5 | 0.5 | 0.5 | 0.5 | 0.5 |
| | Dicumyl peroxide | 0.9 | 0.9 | 0.9 | 0.9 | 0.9 | 0.9 |
| Mid layer | Himilan 1605 | 50 | 50 | 50 | 50 | 50 | 50 |
| | Surlyn 9945 | 50 | 50 | 50 | 50 | 50 | 50 |
| | Titanium dioxide | 4 | 4 | 4 | 4 | 4 | 4 |
| | Ultramarine blue | 0.1 | 0.1 | 0.1 | 0.1 | 0.1 | 0.1 |
| Cover | Rabalon SR04* | — | — | — | — | — | — |
| | Rezamin PS62490 | — | — | — | — | — | — |
| | Rezamin P4585LS | — | — | — | — | — | — |
| | Elastollan XNY80A | 100 | — | — | — | — | 100 |
| | Elastollan XNY85A | — | — | — | — | — | — |
| | Elastollan XNY90A | — | 100 | — | 100 | 100 | — |
| | Elastollan XNY97A | — | — | 100 | — | — | — |
| | Elastollan XKP016A | — | — | — | — | — | — |
| | Titanium dioxide | 4 | 4 | 4 | 4 | 4 | 4 |
| | Ultramarine blue | 0.1 | 0.1 | 0.1 | 0.1 | 0.1 | 0.1 |

*Styrene block-containing thermoplastic elastomer by Mitsubishi Chemical Corporation

TABLE 2

| | | Composition | | | | |
|---|---|---|---|---|---|---|
| | | Example 7 | Example 8 | Example 9 | Example 10 | Example 11 |
| Center inner sphere | Polybutadiene | 100 | 100 | 100 | 100 | 100 |
| | Zinc diacrylate | 33.0 | 33.0 | 28.0 | 33.0 | 33.0 |
| | Zinc oxide | 5.0 | 5.0 | 5.0 | 5.0 | 5.0 |
| | Barium sulfate | appropriate amount | appropriate amount | appropriate amount | appropriate amount | appropriate amount |
| | Diphenyl disulfide | 0.5 | 0.5 | 0.5 | 0.5 | 0.5 |
| | Dicumyl peroxide | 0.9 | 0.9 | 0.9 | 0.9 | 0.9 |
| Center outer layer | Polybutadiene | 100 | 100 | 100 | 100 | 100 |
| | Zinc diacrylate | 40.0 | 40.0 | 40.0 | 40.0 | 40.0 |
| | Zinc oxide | 5.0 | 5.0 | 5.0 | 5.0 | 5.0 |
| | Barium sulfate | 10.0 | 10.0 | 10.0 | 10.0 | 10.0 |
| | Diphenyl disulfide | 0.5 | 0.5 | 0.5 | 0.5 | 0.5 |
| | Dicumyl peroxide | 0.9 | 0.9 | 0.9 | 0.9 | 0.9 |
| Mid layer | Himilan 1605 | 50 | 50 | 50 | 50 | 50 |
| | Surlyn 9945 | 50 | 50 | 50 | 50 | 50 |

TABLE 2-continued

| | | Composition | | | | |
|---|---|---|---|---|---|---|
| | | Example 7 | Example 8 | Example 9 | Example 10 | Example 11 |
| | Titanium dioxide | 4 | 4 | 4 | 4 | 4 |
| | Ultramarine blue | 0.1 | 0.1 | 0.1 | 0.1 | 0.1 |
| Cover | Rabalon SR04* | — | — | 50 | — | — |
| | Rezamin PS62490 | — | — | — | — | — |
| | Rezamin P4585LS | — | — | 50 | — | — |
| | Elastollan XNY80A | — | — | — | — | — |
| | Elastollan XNY85A | — | — | — | — | — |
| | Elastollan XNY90A | 100 | 100 | — | 100 | 100 |
| | Elastollan XNY97A | — | — | — | — | — |
| | Elastollan XKP016A | — | — | — | — | — |
| | Titanium dioxide | 4 | 4 | 4 | 4 | 4 |
| | Ultramarine blue | 0.1 | 0.1 | 0.1 | 0.1 | 0.1 |

TABLE 3

| | | Composition | | | | |
|---|---|---|---|---|---|---|
| | | Compa. Example 1 | Compa. Example 2 | Compa. Example 3 | Compa. Example 4 | Compa. Example 5 |
| Center inner sphere | Polybutadiene | 100 | 100 | 100 | 100 | 100 |
| | Zinc diacrylate | 33.0 | 26.0 | 26.0 | 33.0 | 27.0 |
| | Zinc oxide | 5.0 | 5.0 | 5.0 | 5.0 | 5.0 |
| | Barium sulfate | appropriate amount | appropriate amount | appropriate amount | appropriate amount | appropriate amount |
| | Diphenyl disulfide | 0.5 | 0.5 | 0.5 | 0.5 | 0.5 |
| | Dicumyl peroxide | 0.9 | 0.9 | 0.9 | 0.9 | 0.9 |
| Center outer layer | Polybutadiene | 100 | 100 | 100 | 100 | 100 |
| | Zinc diacrylate | 40.0 | 40.0 | 40.0 | 40.0 | 40.0 |
| | Zinc oxide | 5.0 | 5.0 | 5.0 | 5.0 | 5.0 |
| | Barium sulfate | 10.0 | 10.0 | 10.0 | 10.0 | 10.0 |
| | Diphenyl disulfide | 0.5 | 0.5 | 0.5 | 0.5 | 0.5 |
| | Dicumyl peroxide | 0.9 | 0.9 | 0.9 | 0.9 | 0.9 |
| Mid layer | Himilan 1605 | 50 | 50 | 50 | 50 | 50 |
| | Surlyn 9945 | 50 | 50 | 50 | 50 | 50 |
| | Titanium dioxide | 4 | 4 | 4 | 4 | 4 |
| | Ultramarine blue | 0.1 | 0.1 | 0.1 | 0.1 | 0.1 |
| Cover | Rabalon SR04* | — | 50 | — | — | 50 |
| | Rezamin PS62490 | — | 50 | — | — | 50 |
| | Rezamin P4585LS | — | — | — | — | — |
| | Elastollan XNY80A | — | — | — | — | — |
| | Elastollan XNY85A | — | — | — | — | — |
| | Elastollan XNY90A | 100 | — | — | — | — |
| | Elastollan XNY97A | — | — | 50 | — | — |
| | Elastollan XKP016A | — | — | 50 | 100 | — |
| | Titanium dioxide | 4 | 4 | 4 | 4 | 4 |
| | Ultramarine blue | 0.1 | 0.1 | 0.1 | 0.1 | 0.1 |

TABLE 4

| | | Results of Evaluation | | | | | |
|---|---|---|---|---|---|---|---|
| | | Example 1 | Example 2 | Example 3 | Example 4 | Example 5 | Example 6 |
| Center inner sphere | Diameter (mm) | 32.4 | 32.4 | 32.4 | 32.8 | 32.0 | 32.0 |
| | Central hardness Hi | 33 | 33 | 33 | 34 | 33 | 33 |
| | Surface hardness Hsi | 51 | 51 | 51 | 52 | 51 | 51 |
| | Amount of compressive deformation Di (mm) | 4.90 | 4.90 | 4.90 | 4.60 | 4.90 | 4.80 |
| Center outer layer | Thickness To (mm) | 3.3 | 3.3 | 3.3 | 3.3 | 3.3 | 3.3 |
| Center | Surface hardness Hs1 | 61 | 61 | 61 | 61 | 61 | 61 |
| | Amount of compressive deformation D1 (mm) | 3.60 | 3.60 | 3.60 | 3.35 | 3.60 | 3.60 |
| Mid layer | Thickness Tm (mm) | 1.6 | 1.6 | 1.6 | 1.6 | 1.6 | 1.6 |
| | Hardness Hm | 63 | 63 | 63 | 63 | 63 | 63 |
| Core | Amount of compressive deformation D2 (mm) | 3.00 | 3.00 | 3.00 | 2.80 | 3.00 | 3.00 |
| | Surface hardness Hs2 | 65 | 65 | 65 | 65 | 65 | 65 |

TABLE 4-continued

| | | Results of Evaluation | | | | | |
|---|---|---|---|---|---|---|---|
| | | Example 1 | Example 2 | Example 3 | Example 4 | Example 5 | Example 6 |
| Reinforcing layer | Thickness Tr (μm) | 10 | 10 | 10 | 10 | 10 | 10 |
| Cover | Thickness Tc (mm) | 0.3 | 0.3 | 0.3 | 0.1 | 0.5 | 0.5 |
| | Hardness Hc | 26 | 38 | 47 | 38 | 38 | 26 |
| Ball | Surface hardness Hs3 | 64 | 65 | 66 | 65 | 64 | 63 |
| | Amount of compressive deformation D3 (mm) | 2.89 | 2.87 | 2.80 | 2.73 | 2.85 | 2.83 |
| | Compression (PGA) | 86 | 87 | 89 | 91 | 87 | 88 |
| | Ratio (D2/D3) | 1.038 | 1.045 | 1.071 | 1.026 | 1.053 | 1.060 |
| | Moment of inertia ($g \cdot cm^2$) | 81.3 | 81.4 | 81.5 | 81.1 | 81.5 | 81.4 |
| Driver | Ball speed (m/s) | 75.4 | 75.4 | 75.4 | 75.4 | 75.2 | 75.2 |
| | Spin rate (rpm) | 2300 | 2250 | 2180 | 2300 | 2400 | 2450 |
| | Flight distance (m) | 267.2 | 268.3 | 269.8 | 269.0 | 265.8 | 264.7 |
| Short iron | Spin rate (rpm) | 6200 | 6100 | 5950 | 6100 | 6300 | 6400 |
| | Spin stability | A | A | B | A | A | A |
| Feel at impact | | A | A | A | A | A | A |
| Scuff resistance performance | | A | A | A | A | A | A |

TABLE 5

| | | Results of Evaluation | | | | |
|---|---|---|---|---|---|---|
| | | Example 7 | Example 8 | Example 9 | Example 10 | Example 11 |
| Center inner sphere | Diameter (mm) | 32.4 | 32.0 | 32.8 | 31.4 | 31.0 |
| | Central hardness Hi | 39 | 39 | 35 | 39 | 39 |
| | Surface hardness Hsi | 57 | 57 | 53 | 57 | 57 |
| | Amount of compressive deformation Di (mm) | 3.90 | 3.90 | 4.55 | 3.90 | 3.90 |
| Center outer layer | Thickness To (mm) | 3.3 | 3.3 | 3.3 | 3.3 | 3.3 |
| Center | Surface hardness Hs1 | 61 | 61 | 61 | 61 | 61 |
| | Amount of compressive deformation D1 (mm) | 3.00 | 3.00 | 3.40 | 3.00 | 3.00 |
| Mid layer | Thickness Tm (mm) | 1.6 | 1.6 | 1.6 | 1.6 | 1.6 |
| | Hardness Hm | 63 | 63 | 63 | 63 | 63 |
| Core | Amount of compressive deformation D2 (mm) | 2.55 | 2.55 | 2.80 | 2.55 | 2.55 |
| | Surface hardness Hs2 | 65 | 65 | 65 | 65 | 65 |
| Reincorcing layer | Thickness Tr (μm) | 10 | 10 | 10 | 10 | 10 |
| Cover | Thickness Tc (mm) | 0.3 | 0.5 | 0.1 | 0.8 | 1.0 |
| | Hardness Hc | 38 | 38 | 22 | 38 | 38 |
| Ball | Surface hardness Hs3 | 65 | 64 | 63 | 63 | 63 |
| | Amount of compressive deformation D3 (mm) | 2.42 | 2.35 | 2.83 | 2.38 | 2.33 |
| | Compression (PGA) | 102 | 104 | 88 | 103 | 105 |
| | Ratio (D2/D3) | 1.054 | 1.085 | 0.989 | 1.071 | 1.094 |
| | Moment of inertia ($g \cdot cm^2$) | 81.4 | 81.6 | 81.0 | 81.7 | 81.9 |
| Driver | Ball speed (m/s) | 75.6 | 75.4 | 74.7 | 75.2 | 75.2 |
| | Spin rate (rpm) | 2350 | 2500 | 2550 | 2650 | 2670 |
| | Flight distance (m) | 269.7 | 266.3 | 264.5 | 263.5 | 263.3 |
| Short iron | Spin rate (rpm) | 6300 | 6500 | 6600 | 6700 | 6800 |
| | Spin stability | A | A | A | A | A |
| Feel at impact | | A | A | A | A | A |
| Scuff resistance performance | | A | A | A | A | A |

TABLE 6

| | | Results of Evaluation | | | | |
|---|---|---|---|---|---|---|
| | | Compa. Example 1 | Compa. Example 2 | Compa. Example 3 | Compa. Example 4 | Compa. Example 5 |
| Center inner sphere | Diameter (mm) | 30.6 | 32.4 | 32.4 | 32.4 | 32.8 |
| | Central hardness Hi | 39 | 33 | 33 | 39 | 34 |
| | Surface hardness Hsi | 57 | 51 | 51 | 57 | 51 |

TABLE 6-continued

| | | Results of Evaluation | | | | |
|---|---|---|---|---|---|---|
| | | Compa. Example 1 | Compa. Example 2 | Compa. Example 3 | Compa. Example 4 | Compa. Example 5 |
| | Amount of compressive deformation Di (mm) | 3.90 | 4.90 | 4.90 | 3.90 | 4.70 |
| Center outer layer | Thickness To (mm) | 3.3 | 3.3 | 3.3 | 3.3 | 3.3 |
| Center | Surface hardness Hs1 | 61 | 61 | 61 | 61 | 61 |
| | Amount of compressive deformation D1 (mm) | 3.00 | 3.60 | 3.60 | 3.00 | 3.50 |
| Mid layer | Thickness Tm (mm) | 1.6 | 1.6 | 1.6 | 1.6 | 1.6 |
| | Hardness Hm | 63 | 63 | 63 | 63 | 63 |
| Core | Amount of compressive deformation D2 (mm) | 2.55 | 3.00 | 3.00 | 2.55 | 2.85 |
| | Surface hardness Hs2 | 65 | 65 | 65 | 65 | 65 |
| Reinforcing layer | Thickness Tr (μm) | 10 | 10 | 10 | 10 | 10 |
| Cover | Thickness Tc (mm) | 1.2 | 0.3 | 0.3 | 0.3 | 0.1 |
| | Hardness Hc | 38 | 18 | 52 | 58 | 18 |
| Ball | Surface hardness Hs3 | 62 | 63 | 67 | 66 | 62 |
| | Amount of compressive deformation D3 (mm) | 2.30 | 2.90 | 2.70 | 2.13 | 2.93 |
| | Compression (PGA) | 106 | 86 | 92 | 112 | 85 |
| | Ratio (D2/D3) | 1.109 | 1.034 | 1.111 | 1.197 | 0.973 |
| | Moment of inertia ($g \cdot cm^2$) | 82.3 | 81.4 | 81.7 | 81.9 | 81.3 |
| Driver | Ball speed (m/s) | 75.0 | 74.8 | 75.4 | 75.7 | 74.5 |
| | Spin rate (rpm) | 2800 | 2750 | 2100 | 2350 | 2400 |
| | Flight distance (m) | 260.0 | 262.2 | 270.5 | 268.8 | 261.0 |
| Short iron | Spin rate (rpm) | 6900 | 6850 | 5300 | 5500 | 6400 |
| | Spin stability | A | A | C | C | A |
| Feel at impact | | A | B | C | C | B |
| Scuff resistance performance | | A | B | B | C | B |

As is clear from Tables 4 to 6, the golf balls of Examples are excellent in all terms of the resilience performance, spin performance, spin stability, feel at impact and scuff resistance performance. Accordingly, advantages of the present invention are clearly indicated by these results of evaluation.

[Experiment 2]

Example 12

A rubber composition was obtained by kneading 100 parts by weight of polybutadiene (the aforementioned "BR-730"), 33.0 parts by weight of zinc diacrylate (the aforementioned "ZN-DA90S"), 5.0 parts by weight of zinc oxide (the aforementioned "zinc oxide type II"), an appropriate amount of barium sulfate, 0.5 part by weight of diphenyldisulfide (manufactured by Sumitomo Seika Chemicals Co., Ltd.) and 0.9 part by weight of dicumyl peroxide (manufactured by NOF Corporation). This rubber composition was placed into a mold having upper and lower mold half each having a hemispherical cavity, and heated under a temperature of 170° C. for 15 minutes to obtain an inner sphere having a diameter of 32.0 mm.

A rubber composition was obtained by kneading 100 parts by weight of polybutadiene (the aforementioned trade name "BR-11"), 40 parts by weight of zinc diacrylate (the aforementioned "ZN-DA90S"), 5.0 parts by weight of zinc oxide (the aforementioned "zinc oxide type II"), 10 parts by weight of barium sulfate, 0.5 part by weight of diphenyldisulfide (manufactured by Sumitomo Seika Chemicals Co., Ltd.) and 0.9 part by weight of dicumyl peroxide (manufactured by NOF Corporation). With the rubber composition, half shells were manufactured. The inner sphere was covered with two pieces of half shells. The inner sphere together with the half shells were placed into a mold having upper and lower mold half each having a hemispherical cavity, and heated under a temperature of 170° C. for 15 minutes to obtain a center. The center had a diameter of 39.0 mm. The center is formed by the center inner sphere and an center outer layer. The outer layer had a thickness To of 3.3 mm.

A resin composition was obtained by kneading 50 parts by weight of an ionomer resin (the aforementioned "Himilan 1605"), 50 parts by weight of other ionomer resin (the aforementioned "Surlyn® 9945"), 4 parts by weight of titanium dioxide, and 0.1 part by weight of ultramarine in a biaxial extruder. This resin composition was rendered to cover around the center by injection molding to obtain a core. The core had a diameter of 41.8 mm. The core is formed by the center and a mid layer. The mid layer had a thickness Tm of 1.6 mm.

A coating composition containing a two-component cured epoxy resin as a base polymer (the aforementioned trade name "POLIN 750LE") was prepared. The base material liquid of this coating composition consists of 30 parts by weight of a bisphenol A type solid epoxy resin and 70 parts by weight of a solvent. The curing agent liquid of this coating composition consists of 40 parts by weight of denatured polyamide amine, 55 parts by weight of a solvent and 5 parts by weight of titanium dioxide. Weight ratio of the base material liquid and the curing agent liquid is 1/1. This coating composition was coated on the surface of the mid layer with a spray gun, and kept in an atmosphere of 40° C. for 24 hours to give a reinforcing layer. This reinforcing layer had a thickness Tr of 10 μm.

A resin composition was obtained by kneading 100 parts by weight of a thermoplastic polyurethane elastomer (the aforementioned "Elastollan XNY80A"), 4 parts by weight of titanium dioxide, and 0.1 part by weight of ultramarine in a biaxial extruder. Half shells were obtained from this resin composition with compression molding. The core was covered with two pieces of the half shells. The half shells and the core were placed into a final mold having upper and lower half each having a hemispherical cavity and numerous pimples on the inside face of the upper and lower mold to obtain a cover with compression molding. The cover had a thickness Tc of 0.5 mm. Numerous dimples having a shape inverted from the shape of the pimples were formed on the cover. A paint layer was formed around this cover to give a golf ball of Example 12. This golf ball had a diameter of 42.8 mm, and a weight of 45.5 g.

Examples 13 to 20 and Comparative Examples 6 to 9

In a similar manner to Example 12 except that the quality of the materials, the diameter of the inner sphere, the thickness To of the outer layer and the thickness Tc of the cover were as listed in Tables 7 to 12 below, golf balls of Example 13 to 20 and Comparative Examples 6 to 9 were obtained.

[Evaluation]

In the similar manner to Experiment 1, a test of flight distance with a driver, measurement of spin with a short iron, evaluation of feel at impact, and evaluation of scuff resistance performance were carried out. The results are shown in the following Tables 10 to 12.

TABLE 7

| | | Composition | | | | |
|---|---|---|---|---|---|---|
| | | Example 12 | Example 13 | Example 14 | Example 15 | Example 16 |
| Center inner sphere | Polybutadiene | 100 | 100 | 100 | 100 | 100 |
| | Zinc diacrylate | 33.0 | 33.0 | 33.0 | 24.0 | 27.5 |
| | Zinc oxide | 5.0 | 5.0 | 5.0 | 5.0 | 5.0 |
| | Barium sulfate | appropriate amount | appropriate amount | appropriate amount | appropriate amount | appropriate amount |
| | Diphenyl disulfide | 0.5 | 0.5 | 0.5 | 0.5 | 0.5 |
| | Dicumyl peroxide | 0.9 | 0.9 | 0.9 | 0.9 | 0.9 |
| Cente outer layer | Polybutadiene | 100 | 100 | 100 | 100 | 100 |
| | Zinc diacrylate | 40.0 | 40.0 | 40.0 | 40.0 | 40.0 |
| | Zinc oxide | 5.0 | 5.0 | 5.0 | 5.0 | 5.0 |
| | Barium sulfate | 10.0 | 10.0 | 10.0 | 10.0 | 10.0 |
| | Diphenyl disulfide | 0.5 | 0.5 | 0.5 | 0.5 | 0.5 |
| | Dicumyl peroxide | 0.9 | 0.9 | 0.9 | 0.9 | 0.9 |
| Mid layer | Himilan 1605 | 50 | 50 | 50 | 50 | 50 |
| | Surlyn 9945 | 50 | 50 | 50 | 50 | 50 |
| | Titanium dioxide | 4 | 4 | 4 | 4 | 4 |
| | Ultramarine blue | 0.1 | 0.1 | 0.1 | 0.1 | 0.1 |
| Cover | Elastollan XNY80A | 100 | — | — | — | 100 |
| | Elastollan XNY85A | — | — | — | 100 | — |
| | Elastollan XNY90A | — | 100 | 100 | — | — |
| | Elastollan XNY97A | — | — | — | — | — |
| | Elastollan XKP016A | — | — | — | — | — |
| | Rabalon T3221C* | — | — | — | — | — |
| | Titanium dioxide | 4 | 4 | 4 | 4 | 4 |
| | Ultramarine blue | 0.1 | 0.1 | 0.1 | 0.1 | 0.1 |

*Styrene block-containing thermoplastic elastomer by Mitsubishi Chemical Corporation

TABLE 8

| | | Composition | | | |
|---|---|---|---|---|---|
| | | Example 17 | Example 18 | Example 19 | Example 20 |
| Center inner sphere | Polybutadiene | 100 | 100 | 100 | 100 |
| | Zinc diacrylate | 27.5 | 27.5 | 27.5 | 27.5 |
| | Zinc oxide | 5.0 | 5.0 | 5.0 | 5.0 |
| | Barium sulfate | appropriate amount | appropriate amount | appropriate amount | appropriate amount |
| | Diphenyl disulfide | 0.5 | 0.5 | 0.5 | 0.5 |
| | Dicumyl peroxide | 0.9 | 0.9 | 0.9 | 0.9 |
| Center outer layer | Polybutadiene | 100 | 100 | 100 | 100 |
| | Zinc diacrylate | 40.0 | 40.0 | 40.0 | 40.0 |
| | Zinc oxide | 5.0 | 5.0 | 5.0 | 5.0 |
| | Barium sulfate | 10.0 | 10.0 | 10.0 | 10.0 |
| | Diphenyl disulfide | 0.5 | 0.5 | 0.5 | 0.5 |
| | Dicumyl peroxide | 0.9 | 0.9 | 0.9 | 0.9 |
| Mid layer | Himilan 1605 | 50 | 50 | 50 | 50 |
| | Surlyn 9945 | 50 | 50 | 50 | 50 |

TABLE 8-continued

| | | Composition | | | |
|---|---|---|---|---|---|
| | | Example 17 | Example 18 | Example 19 | Example 20 |
| | Titanium dioxide | 4 | 4 | 4 | 4 |
| | Ultramarine blue | 0.1 | 0.1 | 0.1 | 0.1 |
| Cover | Elastollan XNY80A | 100 | 60 | 100 | 100 |
| | Elastollan XNY85A | — | — | — | — |
| | Elastollan XNY90A | — | — | — | — |
| | Elastollan XNY97A | — | — | — | — |
| | Elastollan XKP016A | — | — | — | — |
| | Rabalon T3221C | — | 40 | — | — |
| | Titanium dioxide | 4 | 4 | 4 | 4 |
| | Ultramarine blue | 0.1 | 0.1 | 0.1 | 0.1 |

TABLE 7

| | | Composition | | | | |
|---|---|---|---|---|---|---|
| | | Example 12 | Example 13 | Example 14 | Example 15 | Example 16 |
| Center inner sphere | Polybutadiene | 100 | 100 | 100 | 100 | 100 |
| | Zinc diacrylate | 33.0 | 33.0 | 33.0 | 24.0 | 27.5 |
| | Zinc oxide | 5.0 | 5.0 | 5.0 | 5.0 | 5.0 |
| | Barium sulfate | appropriate amount | appropriate amount | appropriate amount | appropriate amount | appropriate amount |
| | Diphenyl disulfide | 0.5 | 0.5 | 0.5 | 0.5 | 0.5 |
| | Dicumyl peroxide | 0.9 | 0.9 | 0.9 | 0.9 | 0.9 |
| Center outer layer | Polybutadiene | 100 | 100 | 100 | 100 | 100 |
| | Zinc diacrylate | 40.0 | 40.0 | 40.0 | 40.0 | 40.0 |
| | Zinc oxide | 5.0 | 5.0 | 5.0 | 5.0 | 5.0 |
| | Barium sulfate | 10.0 | 10.0 | 10.0 | 10.0 | 10.0 |
| | Diphenyl disulfide | 0.5 | 0.5 | 0.5 | 0.5 | 0.5 |
| | Dicumyl peroxide | 0.9 | 0.9 | 0.9 | 0.9 | 0.9 |
| Mid layer | Himilan 1605 | 50 | 50 | 50 | 50 | 50 |
| | Surlyn 9945 | 50 | 50 | 50 | 50 | 50 |
| | Titanium dioxide | 4 | 4 | 4 | 4 | 4 |
| | Ultramarine blue | 0.1 | 0.1 | 0.1 | 0.1 | 0.1 |
| Cover | Elastollan XNY80A | 100 | — | — | — | 100 |
| | Elastollan XNY85A | — | — | — | 100 | — |
| | Elastollan XNY90A | — | 100 | 100 | — | — |
| | Elastollan XNY97A | — | — | — | — | — |
| | Elastollan XKP016A | — | — | — | — | — |
| | Rabalon T3221C* | — | — | — | — | — |
| | Titanium dioxide | 4 | 4 | 4 | 4 | 4 |
| | Ultramarine blue | 0.1 | 0.1 | 0.1 | 0.1 | 0.1 |

*Styrene block-containing thermoplastic elastomer by Mitsubishi Chemical Corporation

TABLE 10

| | | Results of Evaluation | | | | |
|---|---|---|---|---|---|---|
| | | Example 12 | Example 13 | Example 14 | Example 15 | Example 16 |
| Center inner sphere | Diameter (mm) | 32.0 | 32.0 | 31.8 | 32.0 | 32.0 |
| | Central hardness Hi | 39 | 39 | 39 | 39 | 34 |
| | Surface hardness Hsi | 57 | 57 | 57 | 57 | 52 |
| | Amount of compressive deformation Di (mm) | 3.90 | 3.90 | 3.90 | 4.90 | 4.50 |
| Center outer layer | Thickness To (mm) | 3.3 | 3.3 | 3.3 | 3.3 | 3.3 |
| Center | Surface hardness Hs1 | 61 | 61 | 61 | 61 | 61 |
| | Amount of compressive deformation D1 (mm) | 3.00 | 3.00 | 3.00 | 3.60 | 3.30 |
| Mid layer | Thickness Tm (mm) | 1.6 | 1.6 | 1.6 | 1.6 | 1.6 |
| | Hardness Hm | 63 | 63 | 63 | 63 | 63 |
| Core | Amount of compressive deformation D2 (mm) | 2.55 | 2.55 | 2.55 | 3.00 | 2.80 |
| Reinforcing layer | Thickness Tr (μm) | 10 | 10 | 10 | 10 | 10 |

TABLE 10-continued

| | | Results of Evaluation | | | | |
|---|---|---|---|---|---|---|
| | | Example 12 | Example 13 | Example 14 | Example 15 | Example 16 |
| Cover | Thickness Tc (mm) | 0.5 | 0.5 | 0.6 | 0.5 | 0.5 |
| | Hardnes Hc | 26 | 38 | 38 | 32 | 26 |
| | Tc * Hc | 13.0 | 19.0 | 22.8 | 16.0 | 13.0 |
| Ball | Amount of compressive deformation D3 (mm) | 2.38 | 2.35 | 2.33 | 2.82 | 2.63 |
| | Compression (PGA) | 103 | 104 | 105 | 88 | 95 |
| | Hi − Hc | 13 | 1 | 1 | 7 | 8 |
| Driver | Ball speed (m/s) | 75.4 | 75.4 | 75.3 | 75.0 | 75.1 |
| | Spin rate (rpm) | 2550 | 2500 | 2550 | 2450 | 2560 |
| | Flight distance (m) | 265.2 | 266.3 | 265.4 | 265.0 | 264.8 |
| Short iron | Spin rate (rpm) | 6600 | 6500 | 6600 | 6400 | 6500 |
| | Spin stability | A | A | A | A | A |
| Feel at impact | | A | A | A | A | A |
| Scuff resistance performance | | A | A | A | A | A |

TABLE 11

| | | Results of Evaluation | | | |
|---|---|---|---|---|---|
| | | Example 17 | Example 18 | Example 19 | Example 20 |
| Center inner sphere | Diameter (mm) | 32.4 | 32.4 | 31.0 | 30.8 |
| | Central hardness Hi | 34 | 34 | 34 | 34 |
| | Surface hardness Hsi | 52 | 52 | 52 | 52 |
| | Amount of compressive deformation Di (mm) | 4.50 | 4.50 | 4.50 | 4.50 |
| Center outer layer | Thickness To (mm) | 3.3 | 3.3 | 3.3 | 3.3 |
| Center | Surface hardness Hs1 | 61 | 61 | 61 | 61 |
| | Amount of compressive deformation D1 (mm) | 3.30 | 3.30 | 3.30 | 3.30 |
| Mid layer | Thickness Tm (mm) | 1.6 | 1.6 | 1.6 | 1.6 |
| | Hardness Hm | 63 | 63 | 63 | 63 |
| Core | Amount of compressive deformation D2 (mm) | 2.80 | 2.80 | 2.80 | 2.80 |
| Reinforcing layer | Thickness Tr (μm) | 10 | 10 | 10 | 10 |
| Cover | Thickness Tc (mm) | 0.3 | 0.3 | 0.8 | 0.9 |
| | Hardness Hc | 26 | 18 | 26 | 26 |
| | Tc * Hc | 7.8 | 5.4 | 20.8 | 23.4 |
| Ball | Amount of compressive deformation D3 (mm) | 2.69 | 2.71 | 2.60 | 2.57 |
| | Compression (PGA) | 93 | 92 | 96 | 97 |
| | Hi − Hc | 8 | 16 | 8 | 8 |
| Driver | Ball speed (m/s) | 75.3 | 75.3 | 74.9 | 74.8 |
| | Spin rate (rpm) | 2400 | 2450 | 2600 | 2650 |
| | Flight distance (m) | 268.2 | 267.9 | 262.1 | 261.8 |
| Short iron | Spin rate (rpm) | 6300 | 6500 | 6500 | 6550 |
| | Spin stability | A | A | A | A |
| Feel at impact | | A | A | A | A |
| Scuff resistance performance | | A | A | A | A |

TABLE 12

| | | Results of Evaluation | | | |
|---|---|---|---|---|---|
| | | Compa. Example 6 | Compa. Example 7 | Compa. Example 8 | Compa. Example 9 |
| Center inner sphere | Diameter (mm) | 32.0 | 30.2 | 32.0 | 32.0 |
| | Central hardness Hi | 39 | 34 | 36 | 39 |
| | Surface hardness Hsi | 57 | 52 | 48 | 57 |
| | Amount of compressive deformation Di (mm) | 3.90 | 4.50 | 4.95 | 3.80 |
| Center outer layer | Thickness To (mm) | 3.3 | 3.3 | 3.3 | 3.5 |

TABLE 12-continued

Results of Evaluation

| | | Compa. Example 6 | Compa. Example 7 | Compa. Example 8 | Compa. Example 9 |
|---|---|---|---|---|---|
| Center | Surface hardness Hs1 | 61 | 61 | 61 | 61 |
| | Amount of compressive deformation D1 (mm) | 3.00 | 3.30 | 3.65 | 2.90 |
| Mid layer | Thickness Tm (mm) | 1.6 | 1.6 | 1.6 | 1.6 |
| | Hardness Hm | 63 | 63 | 63 | 63 |
| Core | Amount of compressive deformation D2 (mm) | 2.55 | 2.80 | 3.10 | 2.42 |
| Reinforcing layer | Thickness Tr (μm) | 10 | 10 | 10 | 10 |
| Cover | Thickness Tc (mm) | 0.5 | 1.2 | 0.5 | 0.3 |
| | Hardness Hc | 52 | 26 | 26 | 58 |
| | Tc * Hc | 26.0 | 31.2 | 13.0 | 17.4 |
| Ball | Amount of compressive deformation D3 (mm) | 2.22 | 2.55 | 2.97 | 2.10 |
| | Compression (PGA) | 109 | 98 | 83 | 113 |
| | Hi − Hc | −13 | 8 | 10 | −19 |
| Driver | Ball speed (m/s) | 75.6 | 74.5 | 74.6 | 75.8 |
| | Spin rate (rpm) | 2400 | 2800 | 2450 | 2300 |
| | Flight distance (m) | 265.6 | 258.6 | 261.1 | 266.8 |
| Short iron | Spin rate (rpm) | 6200 | 6750 | 6300 | 5600 |
| | Spin stability | B | A | A | C |
| Feel at impact | | C | A | A | C |
| Scuff resistance performance | | B | A | A | C |

As is clear from Tables 10 to 12, the golf balls of Examples are excellent in all terms of the flight performance, spin performance, spin stability, feel at impact, and scuff resistance performance. Accordingly, advantages of the present invention are clearly indicated by these results of evaluation.

The description herein above is merely for illustrative examples, and various modifications can be made without departing from the principles of the present invention.

What is claimed is:

1. A golf ball which comprises a spherical core, and a cover positioned outside of the core, said core having a spherical center, and a mid layer positioned outside of the center, said center having a center inner sphere and a center outer layer positioned outside of the inner sphere, wherein a peak in a hardness curve from a center point of said inner sphere to a surface of the cover is attained in the mid layer, said cover having a thickness Tc equal to or less than 1.0 mm, said cover having a hardness Hc of 20 or greater and 50 or less, and wherein a ratio (D2/D3) of the amount of compressive deformation D2 of said core to the amount of compressive deformation D3 of the golf ball is 0.98 or greater and 1.10 or less.

2. The golf ball according to claim 1 wherein said center inner sphere and said center outer layer are formed by a composition including a thermosetting polymer as a base, and the mid layer and the cover are formed by a composition including a thermoplastic polymer as a base.

3. The golf ball according to claim 2 wherein a principal component of a base polymer of said mid layer is an ionomer resin, and a principal component of a base polymer of said cover is thermoplastic polyurethane elastomer.

4. The golf ball according to claim 1 which further has a reinforcing layer having a thickness of 3 μm or greater and 50 μm or less, and being positioned between said mid layer and said cover.

5. The golf ball according to claim 1 wherein a difference (Hs1−Hi) between the surface hardness Hs1 of the center and the central hardness Hi of the inner sphere is 20 or greater.

6. The golf ball according to claim 5 wherein the difference (Hs1 −Hi) is 25 or greater.

7. The golf ball according to claim 1 wherein a difference (Hs1−Hsi) between the surface hardness Hs1 of the center and the surface hardness Hsi of the inner sphere is 1 or greater.

8. The golf ball according to claim 7 wherein the difference (Hs1−Hsi) is 3 or greater.

9. A golf ball which comprises a spherical core, and a cover positioned outside of the core, said core having a spherical center, and a mid layer positioned outside of the center, said center having a center inner sphere and a center outer layer positioned outside of the center inner sphere, and wherein a product (Tc·Hc) of a thickness Tc (mm) of the cover and a hardness Hc of the cover is equal to or less than 25, the amount of compressive deformation is 2.20 or greater and 2.90 or less, and wherein said cover has a hardness Hc which is smaller than the central hardness Hi of the inner sphere.

10. The golf ball according to claim 9 wherein a principal component of a base polymer of said mid layer is an ionomer resin, and a principal component of a base polymer of said cover is a thermoplastic polyurethane elastomer.

11. The golf ball according to claim 9 which further contains a reinforcing layer having a thickness of 3 μm or greater and 50 μm or less, which is positioned between said mid layer and said cover.

12. The golf ball according to claim 9 wherein a difference (Hs1−Hi) between the surface hardness Hs1 of the center and the central hardness Hi of the inner sphere is 20 or greater.

13. The golf ball according to claim 12 wherein the difference (Hs1−Hi) is 25 or greater.

14. The golf ball according to claim 9 wherein a difference (Hs1−Hsi) between the surface hardness Hs1 of the center and the surface hardness Hsi of the inner sphere is 1 or greater.

15. The golf ball according to claim 14 wherein the difference (Hs1−Hsi) is 3 or greater.

16. A golf ball which comprises a spherical core, and a cover positioned outside of the core, said core having a spherical center, and a mid layer positioned outside of the center, said center having a center inner sphere and a center outer layer positioned outside of the inner sphere, wherein said center inner sphere and said center outer layer are formed by a composition including a thermosetting polymer as a base, and the mid layer and the cover are formed by a composition including a thermoplastic polymer as a base, said cover having a thickness Tc equal to or less than 1.0 mm, said cover having a hardness Hc of 20 or greater and 50 or less, and wherein a ratio (D2/D3) of the amount of compressive deformation D2 of said core to the amount of compressive deformation D3 of the golf ball is 0.98 or greater and 1.10 or less.

17. The golf ball according to claim 16 wherein a principal component of a base polymer of said mid layer is an ionomer resin, and a principal component of a base polymer of said cover is thermoplastic polyurethane elastomer.

18. The golf ball according to claim 16 which further has a reinforcing layer having a thickness of 3 μm or greater and 50 μm or less, and being positioned between said mid layer and said cover.

19. The golf ball according to claim 16 wherein a difference (Hs1−Hi) between the surface hardness Hs1 of the center and the central hardness Hi of the inner sphere is 20 or greater.

20. The golf ball according to claim 19 wherein the difference (Hs1−Hi) is 25 or greater.

21. The golf ball according to claim 16 wherein a difference (Hs1−Hsi) between the surface hardness Hs1 of the center and the surface hardness Hsi of the inner sphere is 1 or greater.

22. The golf ball according to claim 21 wherein the difference (Hs1−Hsi) is 3 or greater.

* * * * *